US005667208A

United States Patent [19]

Schroer et al.

[11] Patent Number: 5,667,208

[45] Date of Patent: Sep. 16, 1997

[54] VACUUM CLAMPING SYSTEM FOR ASSEMBLING CABINETS

[75] Inventors: John M. Schroer, Arlington; Gary E. Smith, Berryville, both of Va.

[73] Assignee: American Woodmark Corporation, Winchester, Va.

[21] Appl. No.: 575,541

[22] Filed: Dec. 20, 1995

[51] Int. Cl.[6] ..... B25B 11/00

[52] U.S. Cl. ..... 269/21; 269/41

[58] Field of Search ..... 269/41, 21, 25, 269/296, 297, 315, 316, 137

[56] References Cited

U.S. PATENT DOCUMENTS

| | | | |
|---|---|---|---|
| 3,349,927 | 10/1967 | Blatt . | |
| 3,423,119 | 1/1969 | Stanley . | |
| 3,568,959 | 3/1971 | Blatt . | |
| 3,902,605 | 9/1975 | Hamilton . | |
| 3,965,557 | 6/1976 | Pruitt, Jr. . | |
| 4,093,202 | 6/1978 | Kincaid . | |
| 4,158,455 | 6/1979 | Brown . | |
| 4,265,476 | 5/1981 | Elgart | 269/21 |
| 4,463,980 | 8/1984 | Orii . | |
| 4,623,296 | 11/1986 | McGuire . | |
| 4,703,966 | 11/1987 | Lewecke . | |
| 4,846,483 | 7/1989 | Sorensen | 269/21 |
| 5,082,418 | 1/1992 | Poux et al. . | |
| 5,125,141 | 6/1992 | Katoh et al. . | |
| 5,135,206 | 8/1992 | Martinez | 269/21 |
| 5,201,560 | 4/1993 | Golden . | |

OTHER PUBLICATIONS

Undated sales brochure and drawing of J. M. Lancaster, Inc. Clamping machines Model Nos. 1200–B and 1225, and engineering drawings of Model No. 1205.

*Primary Examiner*—Timothy V. Eley
*Assistant Examiner*—Lee Wilson
*Attorney, Agent, or Firm*—Laubscher & Laubscher

[57] ABSTRACT

A clamping system is provided for assembling the wall panels of wooden kitchen cabinets and the like, including a frame that is normally supported for sliding movement on an assembly table toward an assembling position relative to a workpiece arranged on the table. The frame is vertically displaceable between a normal elevated transport position and a lowered clamping position relative to the assembly table, and a normally-activated device prevents displacement of the frame from the elevated position to the lowered position. A first suction cup is carried by the frame for connecting to the frame a panel that is to be fastened to the workpiece, and a second suction cup is carried by the frame that is operable, when the displacement preventing device is deactivated, to connect the frame to the assembly table, thereby to clamp the panel to the workpiece.

15 Claims, 5 Drawing Sheets

FIG. 11
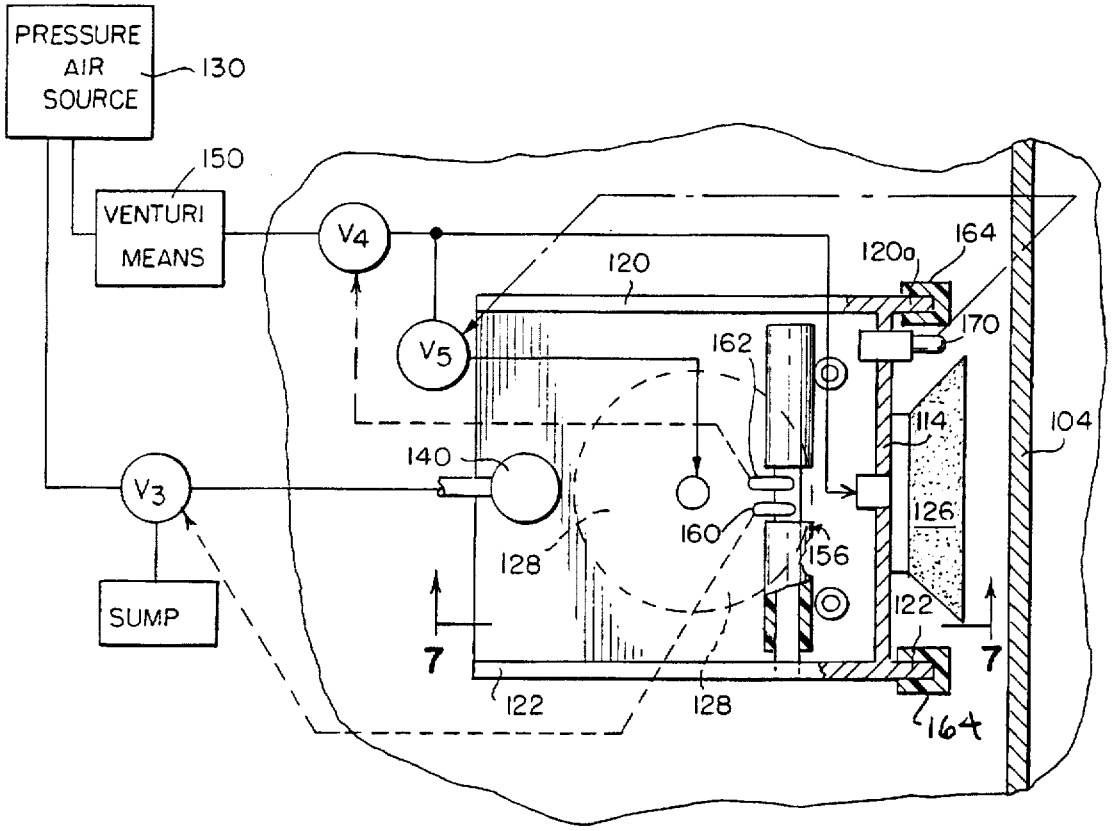
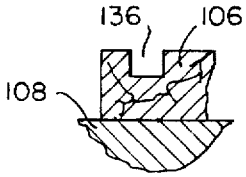
FIG. 12
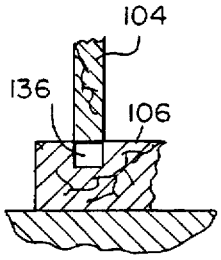
FIG. 13

VACUUM CLAMPING SYSTEM FOR ASSEMBLING CABINETS

BACKGROUND OF THE INVENTION

1. Field of the Invention

This invention relates to a clamping system for clamping together a panel and a workpiece, such as the components of a wooden cabinet, including a frame that is slidably supported on a horizontal assembly table for displacement toward an assembling position adjacent a workpiece mounted on the table, and suction cup means for connecting the frame both to the panel to be joined to the workpiece, and to the assembly table surface, thereby to permit fastening together of the accurately positioned cabinet components. The frame is supported for adjustment between a vertical transport position relative to the table, and a lowered position adapted for connection to the table by a suction cup, displacement preventing means being provided for normally maintaining the frame in the elevated transport position.

2. Brief Description of the Prior Art

Various systems have been proposed in the prior art for clamping together a pair of components to be fastened together, as evidenced by the patents to Katoh U.S. Pat. No. 5,125,141 and Kincaid U.S. Pat. No. 4,093,202, among others. The use of vacuum means for transporting or supporting panels or the like are shown by the patents to Blatt U.S. Pat. No. 3,349,927 and Stanley U.S. Pat. No. 3,423,119.

Also known in the art is a stationary case clamping machine that is manufactured by J. M. Lancaster, Inc. and is used in the manufacture and assembly of cabinets. In general, the current clamping systems on the market are mechanical systems supported on linear slides for width adjustment, and pneumatic cylinder/platen clamping for drawing side panels down into the face frames. The intent of these clamping systems is to "square" the cabinet and position the component pieces for assembly. Adjustment from one size or type cabinet to another is time consuming, involving the repositioning of large platens for width and height.

The present invention was developed to provide an improved clamping apparatus for quickly and accurately positioning a pair of components that are to be fastened together, and which avoids the drawbacks of the known clamping systems.

SUMMARY OF THE INVENTION

Accordingly, a primary object of the present invention is to provide improved clamping apparatus for use in assembling cabinet components and the like, including a frame that is supported for vertical displacement relative to the horizontal surface of an assembly table between an upper transport position and a lowered clamping position, said frame normally being maintained in the transport position by downward displacement preventing means, thereby to permit sliding of the frame on an assembly table toward an assembly position at which the frame is connected by a first suction cup with the cabinet panel, and, after deactivation of the displacement preventing means, is lowered for connection by a second suction cup with the assembly table.

According to a more specific object, the clamping system is operable to position and support one panel or component in a specified position relative to another panel or component, to clamp one component securely to the mating component, and to allow for a re-positioning of the two components at a specified relative position or positions. The clamp is designed to float freely on a work surface, allowing for total adjustability and flexibility.

A preferred embodiment of the invention utilizes a pair of suction cups carried by the frame for connection with the panel to be connected with the cabinet, and with the assembly table, respectively, and is used in the assembly of face frame wood cabinetry. It is designed to clamp the cabinet side panel into the groove of the cabinet face frame at a 90 degree relative position. The clamping action eliminates all bow and gap between the mating surfaces. Once the two components are attached with mechanical and/or adhesive fasteners, the side panel is then re-positioned with the clamp to securely hold the side panels tight against the remaining cabinet box components (top, bottom, back, etc.). A clamp may be used on one or both sides of the cabinet box assembly.

According to another object, the clamping action is achieved through the compression of the vacuum cup as the air is evacuated from the back side. Vacuum pressure is supplied via a vacuum pump integrated into the air logic of the clamp. This vacuum pump is of the conventional venturi-type supplied with compressed air. The sequencing of the two vacuum cups is critical to achieve the desired clamping action. The side panel cup must clamp first, thereby securing the side panel against the vertical clamp frame surfaces. This is then followed by operation of the bottom vacuum cup which pulls the side panel securely into the face frame groove. In this version the sequencing is achieved through an air transfer valve (pneumatic limit switch) activated as the side panel is pulled into position.

According to a further object, the bottom vacuum cup is supported above the work table surface by spring-biased support legs in the front and by a pneumatic cylinder in the rear. This prevents wear on the bottom cup during clamp positioning. The force of the bottom clamp as it pulls against the work surface will compress the spring support legs during the clamping motion, thereby allowing the clamp to seat fully home against the bottom stops.

BRIEF DESCRIPTION OF THE DRAWINGS

Other objects and advantages of the invention will become apparent from a study of the following specification, when viewed in the light of the accompanying drawings, in which:

FIG. 11 is a schematic pneumatic diagram as shown on a top plan view of the apparatus of FIG. 7;

FIGS. 12–16 illustrate the clamping and fastening steps using the apparatus of FIG. 7;

DETAILED DESCRIPTION

Figure 1:
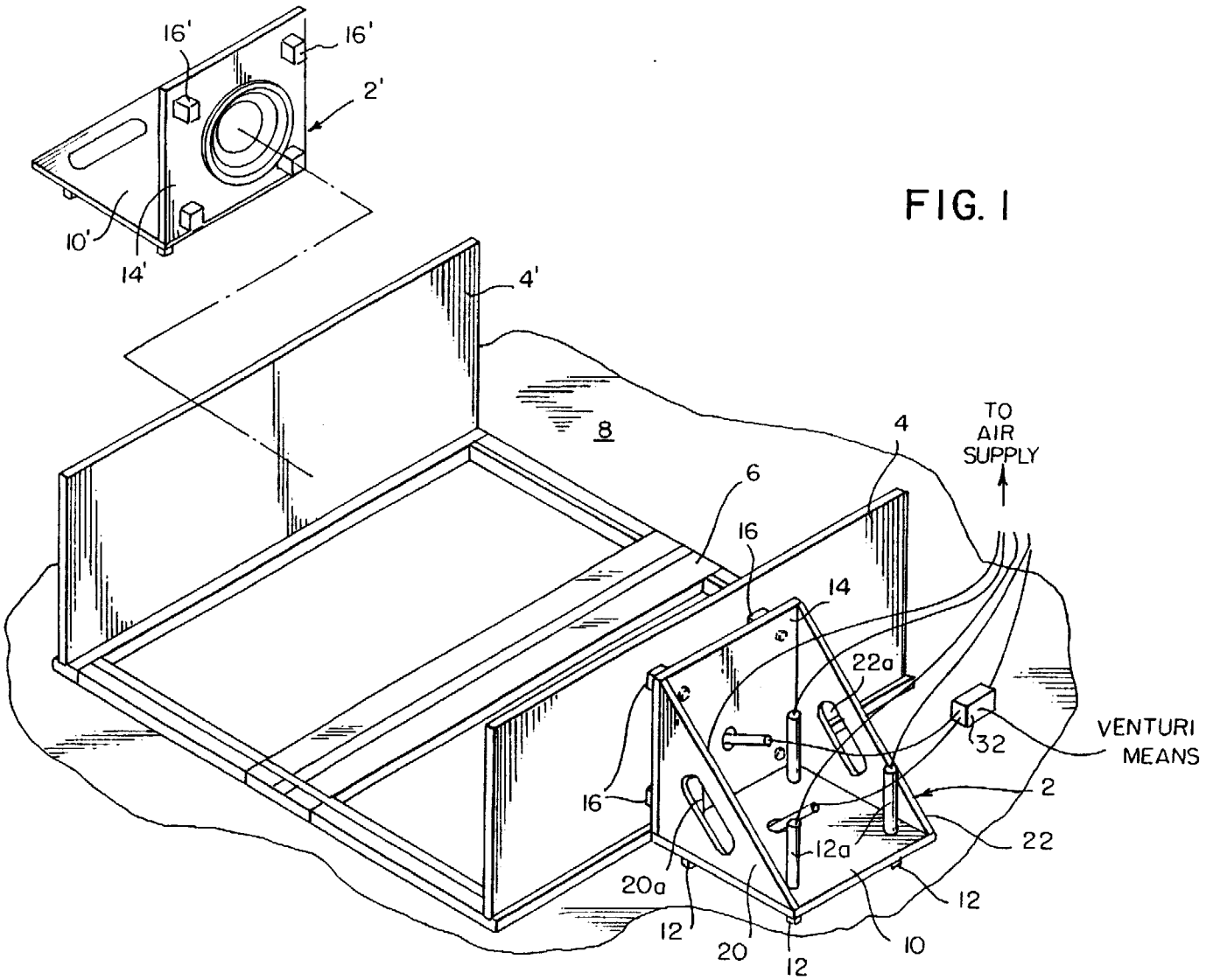
FIG. 1 is a perspective view of a cabinet assembly procedure using a first embodiment of the clamping system of the present invention.

Referring first more particularly to FIG. 1, a first embodiment the clamping means of the present invention including a frame 2 is used to position a vertically arranged cabinet side wall 4 relative to a cabinet front wall 6 arranged on a generally horizontal assembly table 8. The clamping tool includes a bottom wall 10 having a plurality of variable-length support foot means 12 adapted to slidably engage the assembly table 8, and a vertical front wall 14 having a plurality of forwardly extending projections 16 for engaging the adjacent cabinet side wall 4. The frame also includes a pair of parallel spaced side walls 20 and 22.

Referring to FIGS. 2–6, in accordance with a characterizing feature of the invention, a pair of suction cups 26 and 28 are mounted on the frame front wall 14 and bottom wall 16, for engagement with the cabinet side panel 4 and with the assembly table 8, respectively. In accordance with an important feature of the invention, the support feet 12 are of variable length as controlled by pneumatic control cylinder 12*a*, respectively, to which cylinders pressure air from source 30 is provided via control valve means $V_1$, as broadly illustrated in FIG. 3. Vacuum air pressure is provided to the suction cups from pressure air source via second valve means $V_2$ and venturi means 32.

Figure 2:
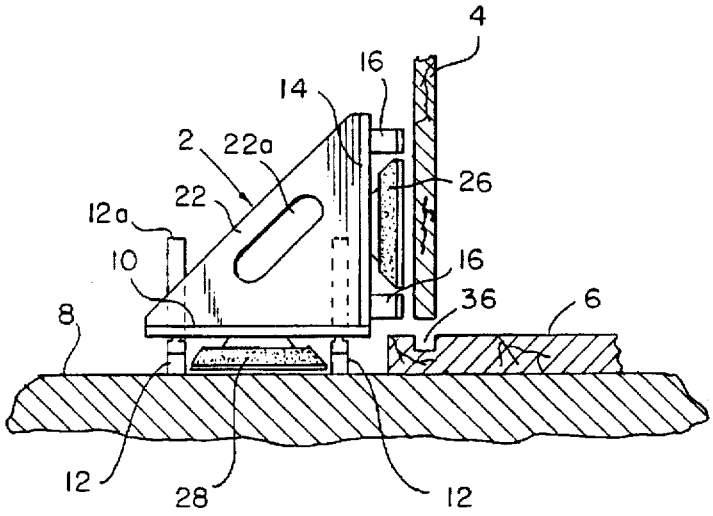
FIG. 2 is a side elevational view of the clamping tool of FIG. 1.
Figure 3:
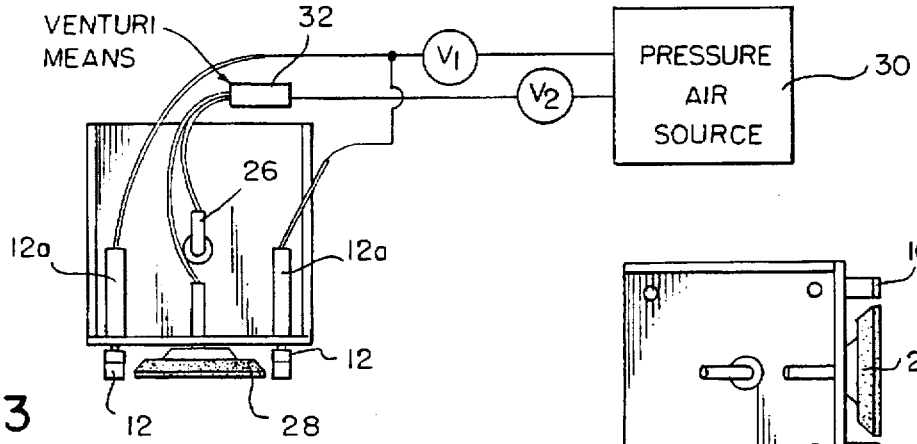
FIG. 3 is a rear view of the apparatus of FIG. 2 as connected in a pneumatic operating schematic.
Figure 5:
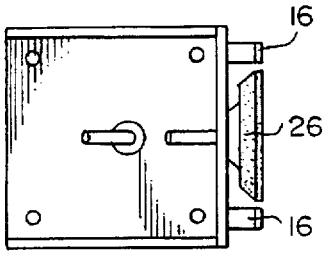
FIGS. 4, 5 and 6 are front, top and bottom views, respectively, of the clamping means of FIG. 2.
Figure 4:
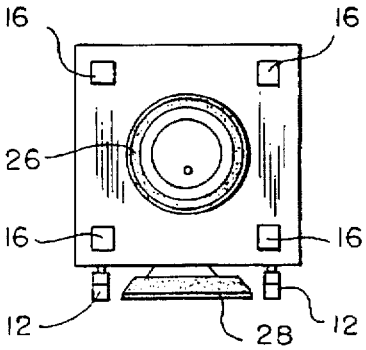
Figure 6:
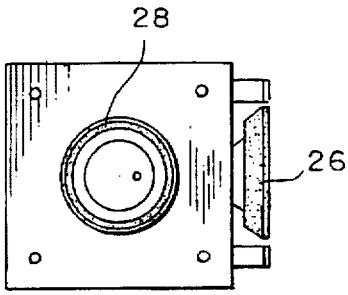
Figure 7:
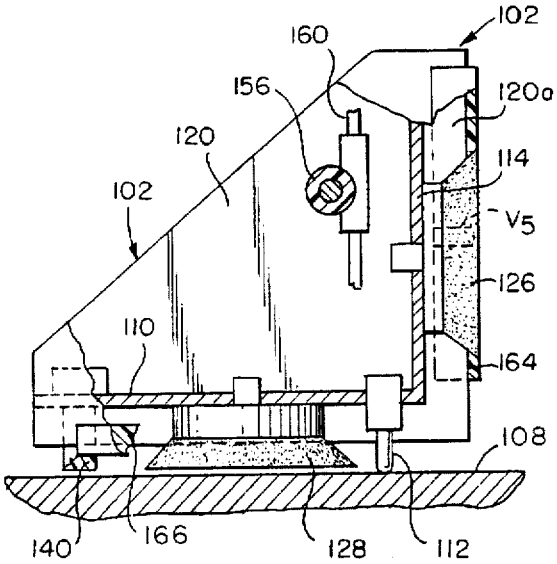
FIGS. 7–10 are partially broken away side elevation, rear, front and bottom views, respectively, of the preferred form of the invention.

In operation, assume that the cabinet side panel 4 is to be fastened in a slot 36 contained in the cabinet front wall 6 that is supported on the assembly table 8, as shown in FIG. 2 in its initial elevated transport condition. With the frame 2 supported solely by the variable length support feet 12, and with the bottom suction cup 28 spaced vertically above the upper surface of the assembly table 8, the frame is slidably displaceable toward the illustrated assembly position of FIG. 2. To this end, the bottom portions of the support feet are preferably formed of a synthetic plastic material having a very low coefficient of friction. Thus, the user by gripping one or both of the side wall handle openings 20*a* and 22*a*, displaces the tool until the forwardly extending stops 16 and the associated vertical suction cup 26 abut the cabinet side panel 4. The first valve means $V_1$ are operated to interrupt the supply of pressure air to the control cylinder 12*a* to lower the frame until the suction cup 28 engages the surface of the work table 8, whereupon valve means $V_2$ are operated to connect suction cup 26 with the sidewall 4 and the bottom suction cup 28 with the assembly table 8. The lower edge of the cabinet side panel 4 is drawn into the slot 36 and is secured thereto either by separate staples or other fastening means, such as adhesive means. When the fastening of the components has been completed, valve means $V_2$ are operated to deactivate the suction cups 26 and 28, and valve means $V_1$ is operated to supply pressure fluid to pressure cylinders 12*a* to elevate the frame to its initial position illustrated in FIG. 2.

Figure 17:
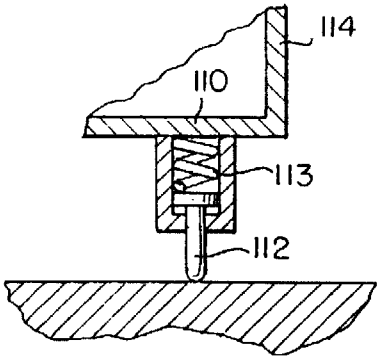
FIG. 17 is a detailed sectional view of a spring-biased support foot of FIG. 7.

According to the preferred embodiment of the invention illustrated in FIGS. 7–11, the frame 102 is supported for sliding transport on the upper surface of the assembly table 108 by variable-length resilient support feet 112 and a displacement-preventing support foot 140 operable by fluid pressure motor 140*a*, whereby the frame is maintained at an elevated transport position to maintain the bottom suction cup 128 spaced slightly above the adjacent surface of the assembly table 108. As best shown in FIG. 17, the support feet 112 are normally biased downwardly by spring means 113 relative to the frame bottom wall 110.

Figure 8:
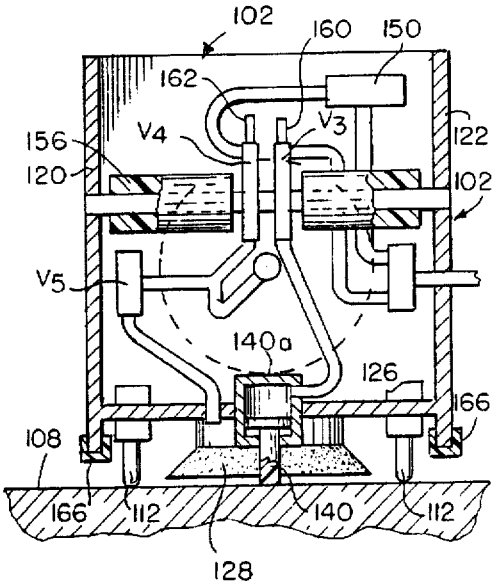
Figure 9:
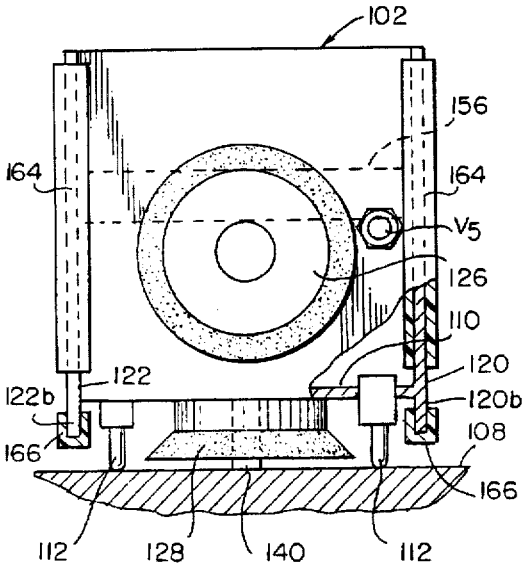
Figure 10:
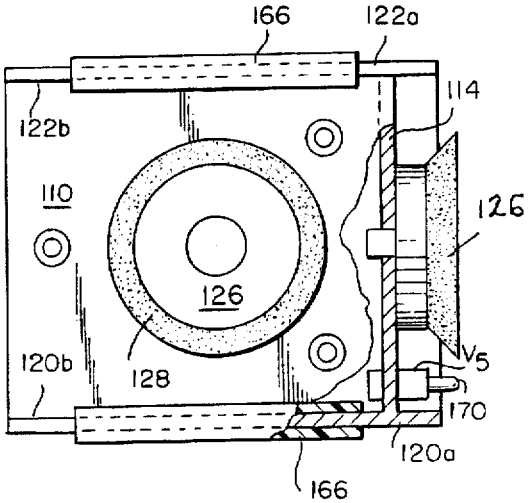
Figure 18:
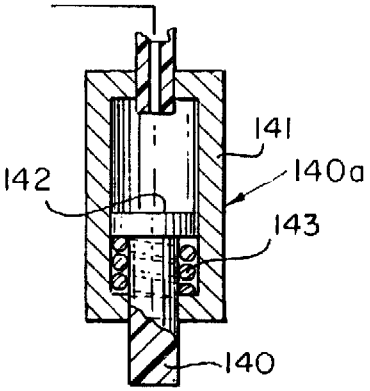

As shown in FIG. 8 and 18, the downward displacement preventing foot 140 is operable by pressure fluid motor means 140*a* which include a piston 142 that is biased upwardly by spring 143 relative to pneumatic cylinder 141 that is normally supplied with pressure air from source 130 (FIG. 11) via valve means $V_3$. Vacuum air is supplied from venturi means 150 to the front suction cup 126 via control valve $V_4$, and vacuum air is supplied to bottom suction cup 128 from venturi means 150 via control valves $V_4$ and $V_5$.

In accordance with a characterizing feature of the invention, cushioned handle means 156 are mounted between the side walls 120 and 122 of the clamping frame 102, which handle means support the control valves $V_3$ and $V_4$ and their manually operable toggle actuators 160 and 162, respectively.

Figure 19:
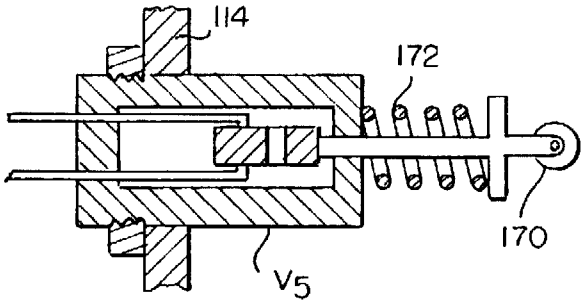
FIGS. 18 and 19 are detailed sectional views of the frame displacing prevention means of FIG. 7, and the proximity responsive control valve of FIG. 11.

In this embodiment, the frame 102 is provided with side walls 120 and 122 that include forwardly extending side wall portions 120*a* and 122*a* that extend beyond the frame front wall 114 toward the cabinet side panel 104. These protecting portions are provided at their forward edges with protective caps 164 that are formed of a suitable synthetic plastic material for protecting the cabinet side wall panels from marring and damage. Similarly, the side walls extend at their bottom edges beyond the bottom wall 110 to define downwardly extending flange portions 120*b* and 122*b* the lower extremities of which are covered by protective cap portions 166. The frame 102 is preferably formed of a light-weight material, such as aluminum. Mounted on the frame front wall 114 is the proximity valve $V_5$ having a forwardly extending movable proximity sensing contact 170 that is biased forwardly by the spring means 172, as shown in FIG. 19. Thus, when the proximity sensor 170 engages the cabinet side wall panel 104, valve $V_5$ is operated to supply vacuum air from venturi means 150 to the bottom suction cup 128 via control valve $V_4$, and proximity control valve $V_5$.

Figure 16:
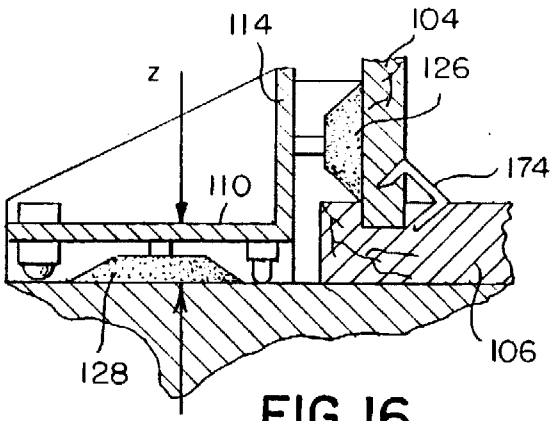
Figure 15:
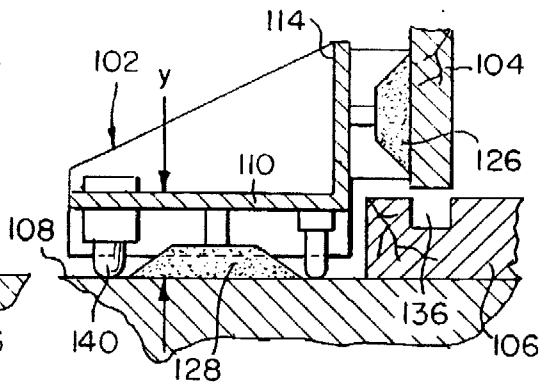
Figure 14:
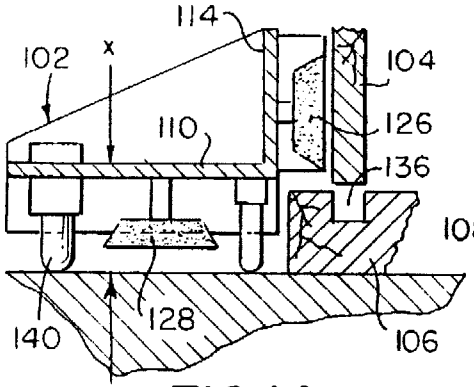

In operation, assume that the frame is in its illustrated upper transport position relative to the upper surface of the assembly table 108. Thus, the frame is supported by the variable length spring-biased support feet 112 and the displacement preventing foot 140 so that the bottom suction cup 128 is in spaced relation to the assembly table. The cabinet front face 106 is positioned on the work table 108 as shown in FIG. 13, and the side panel 104 is positioned above the groove 136 as shown in FIG. 13. The clamping tool 102 is slidably displaced to the assembling position relative to the cabinet components 104 and 106, whereupon toggles 160 and 162 are activated. Activation of toggle 160 operates valve $V_3$ to deactivate the pressure motor means 148*a* and to lower the frame to bring bottom suction cup 128 into contact with the work surface. The cup 128 has not yet been activated. Toggle 162 operates valve $V_4$ to activate suction cup 126, whereupon the panel 104 is pulled to the clamped position, and proximity valve $V_5$ is operated to activate suction cup 128, thereby to connect the frame with the work table surface. The vacuum force overcomes the upwardly directed biasing force of the springs 113 associated with the resilient support feet 112, thereby to reduce the spacing distance from x to y. Thus, the spacing distance z between the assembly table 108 and the frame bottom wall 110 is less than the spacing distance y of FIG. 15, and the lower edge of the side panel 104 is drawn into the slot 136 as shown in FIG. 16. The side panel 104 is maintained in its accurate clamped position relative to the cabinet front 106, whereupon the side panel is fastened to the front panel by staple means 174, adhesive means or the like. Toggle 160 is then activated to activate air cylinder 140*a*, thereby repositioning the angles of cabinet panels 104 and 106. This important repositioning feature is used to clamp the side panels 104 tight to other components of the cabinet box. The toggle actuator 162 is then operated to operate control valve $V_4$ to disconnect the supply of vacuum air to the two suction cups 126 and 128. The tool may then be manually slidably displaced away from the rigidly joined cabinet components, whereupon the procedure is repeated for the next cabinet.

The clamping tool of the present invention is portable, lightweight and flexible to variations in size. No set up times are required, and the tool is adjustable to various clamping angles and configurations. The nature of the vacuum cup geometry results in a greater axial pull strength than shear strength. This can be varied by the design of the vacuum cup. In this particular version the side panel cup is designed to slip on the side panel as the bottom cup is fully seated. The result is an accurate relative positioning of the two panels dictated by the angle and surface of the bottom clamp legs or supports.

Various changes and modifications may be made in the invention, as disclosed. For example, the vacuum panels may be designed with single vacuum cups (as shown), or multiple cups, and the vacuum pressure may be supplied directly from a central vacuum source, or via integrated vacuum pumps supplied with compressed air (as shown). Vacuum sequencing may be achieved through air logic and transfer valves (as shown) or with appropriate relative sizing of the air lines connecting the clamp components. This clamp system may be designed to serve strictly as a support fixture which holds the components in position, or with the clamping action which pulls the joints tight (as shown). The secondary clamping action produced by the air cylinder can be eliminated altogether. It may also be achieved through a wide variety of support legs and cylinder configurations.

While in accordance with the provisions of the Patent Statutes the preferred forms and embodiments of the invention have been illustrated and described, various other changes may be made without deviating from the inventive concepts set forth above.

What is claimed is:

1. Clamping apparatus for clamping a planar member at a given angle relative to a workpiece arranged on a generally-horizontal assembly table, comprising:

(a) a frame;

(b) means supporting said frame for vertical displacement between a normal elevated transport position and a lowered clamping position relative to said assembly table, said frame supporting means normally supporting said frame, when in said elevated position, for sliding displacement on the assembly table toward an assembling position relative to said workpiece, said frame supporting means including normally-activated foot means for preventing displacement of said frame from said elevated position to said lowered position;

(c) means for deactivating said foot means;

(d) first suction cup means carried by said frame for connecting the panel to said frame; and (e) second suction cup means operable when said foot means is deactivated for connecting said frame with the assembly table.

2. Apparatus as defined in claim 1 wherein said foot means includes vertically-arranged pneumatic piston and cylinder motor means (12*a*, 140*a*), a source of pressure air, and first control valve means ($V_1$, $V_3$) for supplying pressure air from said source to said pneumatic motor means, thereby to maintain said frame in said elevated position.

3. Apparatus as defined in claim 2, wherein said first suction cup means includes a first suction cup (26, 126) adjacent the planar member; and first vacuum means (32, 150) including second control valve means ($V_2$, $V_4$) for establishing a negative pressure in said first suction cup.

4. Apparatus as defined in claim 3, wherein said second suction cup means includes a second suction cup (28, 128), and second suction means including valve means ($V_2$, $V_5$) for establishing a negative pressure in said second suction cup.

5. Apparatus as defined in claim 4, wherein said vacuum means comprises venturi means (32, 150) connected with said pressure air source.

6. Apparatus as defined in claim 4, wherein said valve means for establishing a negative pressure in said second suction cup includes third valve means ($V_5$); and further including proximity means (170) mounted on said frame for operating said third valve means when said first suction cup means is connected with the panel.

7. Apparatus as defined in claim 6, wherein said frame includes a vertical front wall carrying said first suction cup, and a horizontal bottom wall carrying said second suction cup.

8. Apparatus as defined in claim 7 wherein said frame further includes a pair of parallel spaced side walls, and handle means connected between said side walls.

9. Apparatus as defined in claim 8, wherein said first and second control valve means include operating means mounted on said handle means.

10. Apparatus as defined in claim 8, wherein said frame side walls have front flange portions that extend forwardly of said front wall for engagement with the panel.

11. Apparatus as defined in claim 10, wherein said side walls have bottom flange portions that extend downwardly relative to said bottom wall for engagement with the assembly table.

12. Apparatus as defined in claim 11, wherein said frame is made of metal; and further including a protective synthetic plastic cap mounted on each of the free edges of said front and bottom flange portions.

13. Apparatus as defined in claim 12, wherein said first suction cup means projects slightly forwardly beyond the adjacent edges of said side wall front flange portions.

14. Apparatus as defined in claim 13, wherein said second suction cup means projects slightly downwardly beyond the adjacent edges of said side wall bottom flange portions.

15. Apparatus as defined in claim 1, wherein said frame support means also includes a plurality of variable-length support feet that are spring-biased downwardly toward maximum length conditions.

* * * * *